United States Patent [19]

Betti

[11] Patent Number: 4,884,381

[45] Date of Patent: Dec. 5, 1989

[54] STRUCTURAL JOINT SYSTEM

[75] Inventor: Pier L. Betti, Sao Paulo, Brazil

[73] Assignee: Jorge Gabrielli Zacharias Calixto, Sao Paulo, Brazil

[21] Appl. No.: 249,195

[22] Filed: Sep. 26, 1988

Related U.S. Application Data

[63] Continuation of Ser. No. 585,620, Mar. 6, 1984, abandoned, which is a continuation of Ser. No. 271,988, Jun. 9, 1981, abandoned, which is a continuation of Ser. No. 29,105, Apr. 11, 1979, abandoned, which is a continuation-in-part of Ser. No. 939,207, Sep. 5, 1978, abandoned, which is a continuation of Ser. No. 803,852, Jun. 6, 1977, abandoned.

[30] Foreign Application Priority Data

Jun. 10, 1976 [BR] Brazil ..... 7603818

[51] Int. Cl.[4] ..... E04B 1/68; E01C 11/02; E01C 11/10

[52] U.S. Cl. ..... 52/741; 404/65; 52/396

[58] Field of Search ..... 52/396; 404/68, 65, 404/49

[56] References Cited

U.S. PATENT DOCUMENTS

| | | | |
|---|---|---|---|
| 2,071,299 | 2/1937 | Gammeter | 404/49 |
| 2,156,681 | 5/1939 | Dewhirst et al. | 404/65 |
| 2,870,881 | 1/1959 | Rogge | 403/5 |
| 3,074,520 | 1/1963 | Grubelich | 403/5 |
| 3,286,425 | 11/1966 | Brown | 52/396 |
| 3,406,087 | 10/1968 | Potter | 52/396 |
| 3,524,390 | 8/1970 | Dill | 404/49 |
| 4,285,612 | 8/1981 | Betti | 52/396 |

FOREIGN PATENT DOCUMENTS

| | | | |
|---|---|---|---|
| 790888 | 7/1968 | Canada | 404/65 |
| 2250003 | 5/1975 | France | 52/396 |
| 213596 | 6/1967 | Sweden | 52/396 |

*Primary Examiner*—James L. Ridgill, Jr.
*Attorney, Agent, or Firm*—John J. Byrne

[57] ABSTRACT

A joinder system for providing a seal between a pair of opposed walls is formed to include a sealing element consisting essentially of a body of resilient material having at least one continuous cavity formed internally thereof, with the cavity being filled with an appropriate material under pressure in order to effect flexure of the sealing element during formation of the joint. Adhesive material is applied externally between the outer walls of the sealing element and the opposed walls which are to be joined together. As the filling material is introduced into the cavity of the sealing element it promotes deformation of the external contour thereof in order to adapt the sealing element to the shape of the joint which is formed and in order simultaneously to apply pressure against the adhesive. The filling material is maintained in a fluid state under pressure while the adhesive is set and it may then be rendered into a rigid or hardened state after setting of the adhesive whereby a permanent seal fitted to the precise shape of the joint contour may be achieved.

1 Claim, 3 Drawing Sheets

STRUCTURAL JOINT SYSTEM

This is a continuation of Ser. No. 585,620, filed Mar. 6, 1984, which was a continuation of Ser. No. 271,988, filed June 9, 1981, now abandoned, which was a continuation of Ser. No. 029,105, filed Apr. 11, 1979, now abandoned, which was a continuation-in-part of Ser. No. 939,207, filed Sept. 5, 1978, now abandoned, which in turn was a continuation of Ser. No. 803,852, filed June 6, 1977, now abandoned.

BACKGROUND OF THE INVENTION

The present invention relates generally to structural elements and more particularly to a sealing joint which may be applied to form a seal between two structural elements, such as a pair of opposed walls of a roadbed or building. In addition to application at building construction sites or in roadways, the invention is also applicable in connection with liquid-bearing structures and it may, for example, be utilized to form a joint between sections of a fluid bearing conduit.

Conventional systems for forming or assembling expansion joints, or other types of joints utilized in construction procedures, where a necessity exists to seal juxtaposed walls after their erection, are usually developed by filling a free space existing between the walls merely by manual introduction into the free space of sealing materials such as tarred ropes, bituminized board, asbestos conglomerates, straps of rubber and similar products. These sealing materials are subsequently either hammered, pressured, pressed or pounded upon the sides of a gap or crevice forming a seat for the material in order that the material may assume an appropriate contour relative to the contour of the sides of the joint whereby a desired sealing effect may be provided.

In addition to the foregoing, other types of conglomerates may be utilized. For example, mineral onsets or mastics made of asphalt or synthetic resins, either with or without solvents, may be applied. Such materials, as well as elastomers, include components which generally represent foreign matter relative to the joint such as may be the case, for example, with polysulphates, this fact being in and of itself a serious inconvenience apart from the inconvenience which may arise because of the prerequisites after application of the material of the immediate on-the-spot curing.

Utilization of the materials of the type discussed above, as well as utilization of procedures and existence of conditions adapted thereto or with other materials, has been found to produce serious shortcomings with regard to the quality of the sealing effect which is obtained in such systems.

The present invention is directed toward providing an improved sealing system. As compared with prior art systems, the system of the present invention provides a practical and economical approach to the problems which arise. The advantages of the invention involve the fact that a seal which is developed through use of the invention offers greater resistance both to static and dynamic pressures and provides optimum performance with regard to the results achieved by its utilization. The sealing system of the invention may be formed with prefabrication techniques in accordance with established design concepts. The invention may be applied for uniting different sections and different types of materials thereby giving rise to versatility with regard to the environment within which the invention may be utilized. Advantages may be derived from the rapidity and security with which the invention may be applied and due to the versatility of its application. The invention may be utilized in open air environments or in underwater locations since the structure is previously cured or vulcanized to form an essentially permanent contour.

In addition to being capable of utilization in specific construction sites, the system of the invention may also be utilized in connection with tubes, conduits, tanks and related mechanical devices which are used to contain or conduct materials of any nature, whether liquid, gaseous or of a viscous state. Furthermore, the invention may be applied to the sealing of concrete blocks or machinery components, including structures of many types where it is desired to form a junction or seal between various elements in a relatively permanent manner.

SUMMARY OF THE INVENTION

Briefly, the present invention may be described as a sealing system particularly applicable for forming a sealed joint between a pair of opposed walls at a construction site, or for other structural purposes, the system being essentially comprised of a sealing element consisting essentially of resilient material and formed to define a cavity internally thereof. An adhesive material is applied between the sealing element and each of a pair of opposed walls between which the joinder is to be formed. A filler material is introduced into the cavity means of the sealing element under pressure and as a result the sealing element undergoes flexure thereby causing the sealing element to expand and adapt its shape to the shape of the walls between which the joint is to be defined. Furthermore, because of the pressure of the filler material internally of the sealing element, the adhesive material provided is maintained under a compressive force. The filler material and the adhesive material are selected such that the adhesive material will set before the filler material hardens. As a result, the filler material is maintained in a liquid state and under pressure during the time that the adhesive sets. After the adhesive material has had an opportunity to set, the filler material will harden and become rigid thereby forming the sealing element as a rigid structural element conforming to the curvature and contours of the joint to be sealed.

The cavity means defined internally of the sealing element may comprise a single continuous cavity or a plurality of separate discrete cavities may be provided in each sealing element.

Furthermore, as an alternative to a filler material which hardens after application thereof, air or some other gas may be utilized to provide the necessary internal pressure within the cavity of the sealing element. The internal cavity of the sealing element may be maintained under pressure while the adhesive sets. Subsequently, the pressure may either be relieved or the cavity means within the sealing element may be sealed while under pressure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
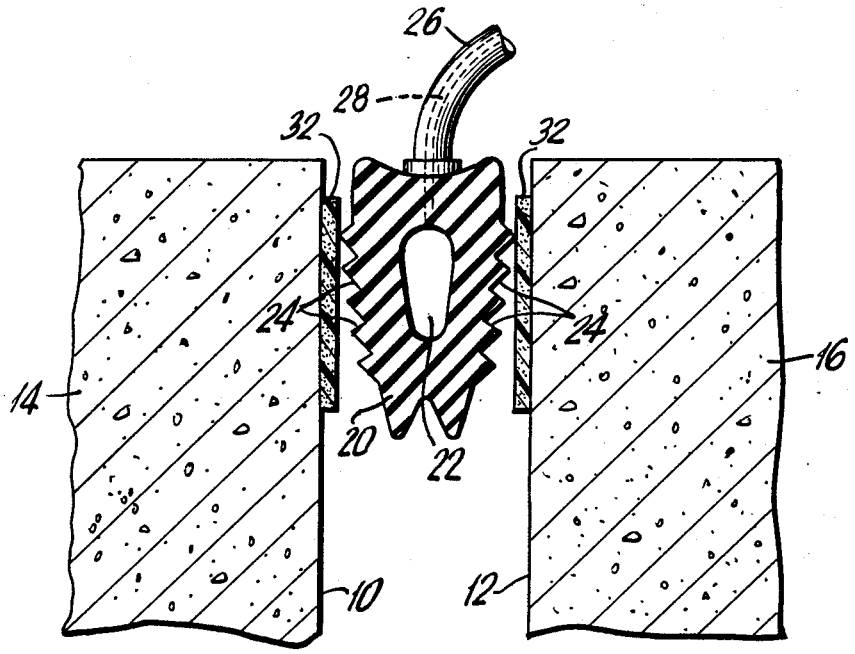
FIG. 1 is a sectional view showing a joint structure during an intermediate stage of the formation of a seal in accordance with the invention.
Figure 2:
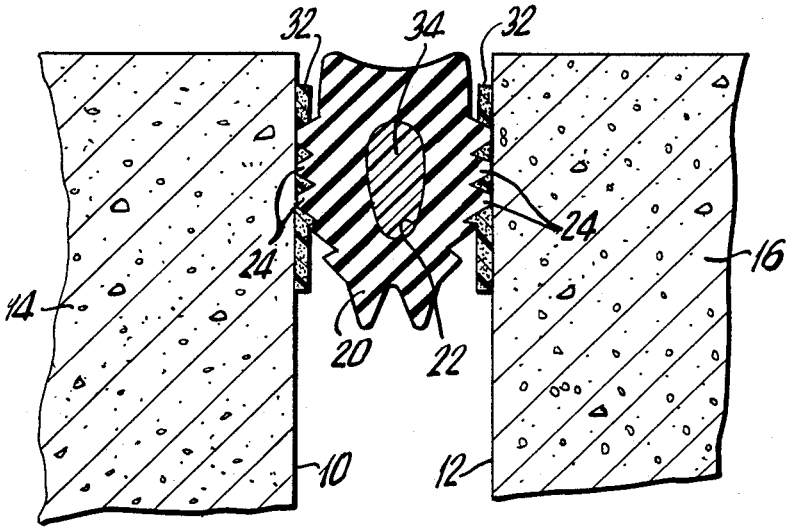
FIG. 2 is a sectional view of the joint or seal of FIG. 1 shown during a subsequent stage of the formation of the seal.

Referring to FIGS. 1 and 2 of the drawing, there is shown an example of a site where the system of the present invention may be utilized to form a seal or joinder between a pair of opposed walls.

Referring specifically to FIG. 1, the walls 10 and 12 may represent the terminations of two sections 14 and 16, respectively, of a roadway. Since roadways are not formed in unbroken, continuous concrete sections, gaps such as that between the walls 10 and 12 will exist between sections of the roadway. Accordingly, it becomes necessary to seal or otherwise join together the walls 10 and 12 so that there will be formed a unitary structure which will, nevertheless, be capable of absorbing relative movements between the walls 10 and 12 which may occur during stressing or loading of the roadway.

The seal of the present invention is shown to essentially comprise a sealing element 20 interposed between the walls 10 and 12.

Figure 4:
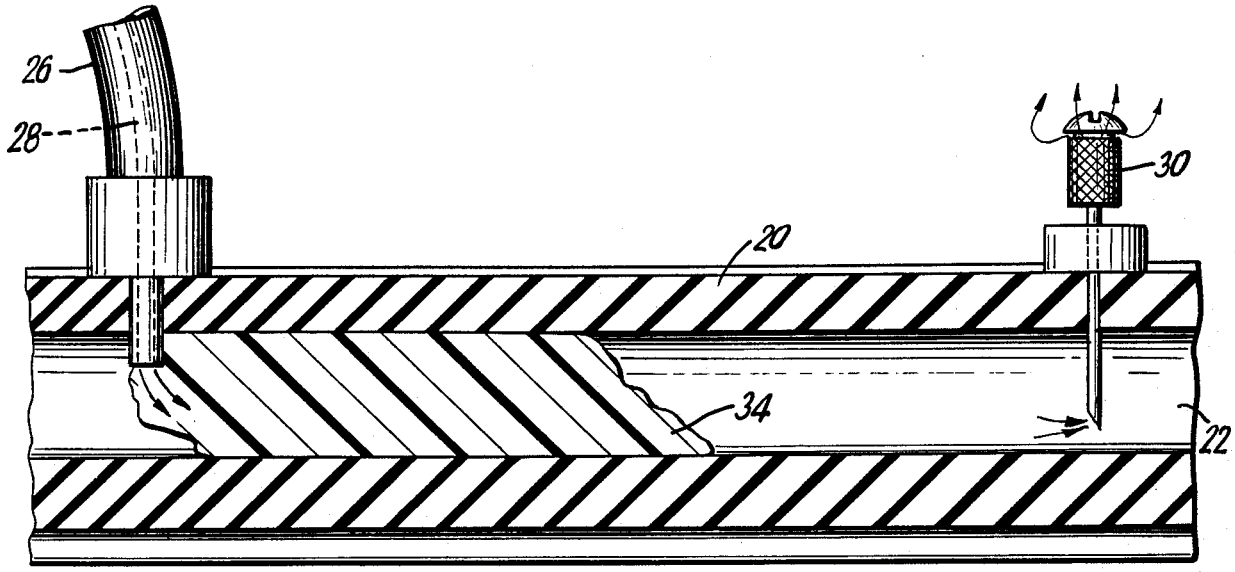
FIG. 4 is a longitudinal sectional view showing the sealing element of the invention during introduction of the filler material.
Figure 5:
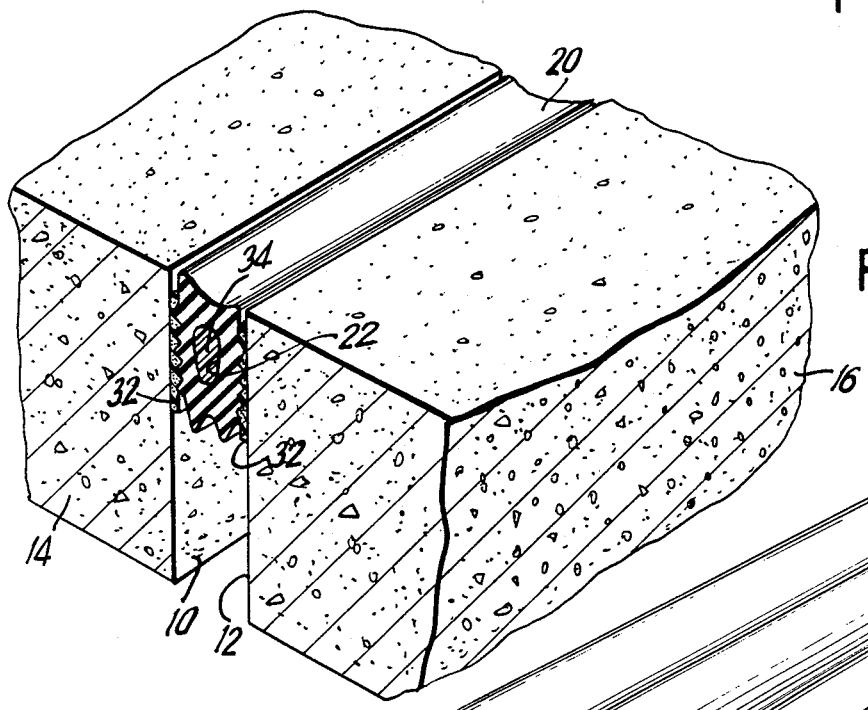
FIG. 5 is a perspective view showing a finished joint formed in accordance with the invention as applied, by way of example, to a roadway.

As best seen in FIG. 5, which depicts the joint system of the present invention in its finished form, the sealing element 20 essentially comprises a longitudinal member of resilient material having cavity means in the form of a single continuous longitudinal cavity 22 formed therein. Additionally, the lateral sides of the sealing element 20 are formed with a plurality of ribs 24 which extend longitudinally along the length of the sealing element 20. A filler tube 26 defining a flow conduit 28 which is in flow communication with the internal cavity 22 of the sealing element 20 is mounted at one end of the element 20. The filler tube 26 is utilized for the particular purpose of introducing into the cavity 22 a filler material, in a manner which will be described more fully hereinafter. As best seen in FIG. 4, the sealing element 20 is also provided with an air outlet valve 30 which will permit air to escape from the cavity 22 when the cavity 22 is filled with a filler material.

In the formation of the joint of the present invention between the walls 10 and 12, an adhesive substance 32 is first applied to each of the walls 10 and 12 on either side of the sealing element 20. After the sealing element 20 has been positioned between the walls 10 and 12 adjacent the adhesive material 32, in the location indicated in FIG. 1, a filler material 34 may be introduced into the cavity 22 through the filler tube 26. In FIG. 4, the sealing element 20 is shown during the process of filling the cavity 22 with the filler material 34. It will be noted that, as the filler material 34 fills the cavity 22, air which is displaced by the filler material 34 will be permitted to escape from within the cavity 22 through the air outlet valve 30.

The filler material 34 is injected into the cavity 22 under pressure and as the pressure within the cavity 22 increases, the sealing element 20, which is formed of a resilient material, will adapt its shape to the shape or configuration of the joint which is to be sealed. Thus, the sealing element 20 will undergo flexure and will change its configuration from the shape shown in FIG. 1 to the shape shown in FIG. 2. As will be clear from FIG. 2, the sealing element 20 has undergone some expansion as a result of the internal pressure produced by the pressurized filler material 34 and as a result the ribs 24 will now press into the adhesive material 32 and against the walls 10 and 12. As a result, the sealing element 20 will be maintained under compression between the walls 10 and 12 and the adhesive material 32 will also be maintained pressed between the sides of the sealing element 20 and the walls 10 and 12. In the selection of materials for the formation of a joint in accordance with the present invention, the filler material 34 is selected so that it will harden only after the adhesive material 32 has set. Thus, while the adhesive material 32 is undergoing a setting process, the filler material 34 remains fluid and continues to apply pressure against the walls 10, 12 and against the adhesive material 32. After the material 32 has fully set in order to form a firm adhesive bond between the sealing element 20 and the walls 10, 12 the filler material 34 will harden and be rendered into a rigid state whereby an effective permanent seal will be attained between the walls 10 and 12, with the seal formed basically by the sealing element 20 having adapted its overall configuration to the configuration of the elements, i.e. the walls 10 and 12, which are to be sealed or joined together.

After the filler material 34 has hardened, the filler tube 26 and the air outlet valve 30 may be removed and a finished joint, ready for appropriate use, will thereby be formed.

Figure 3:
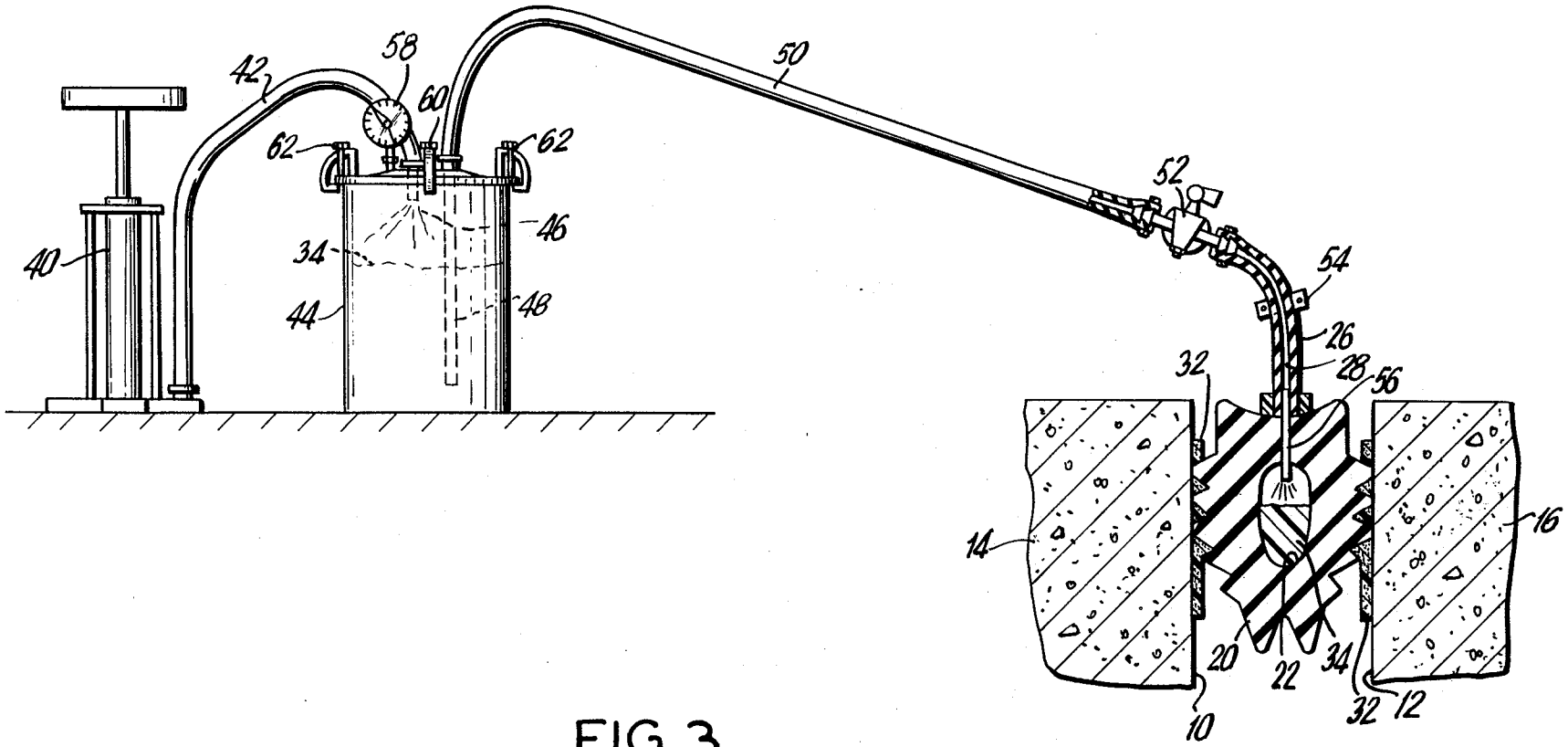
FIG. 3 is a schematic drawing showing apparatus which may be utilized in applying the filler material under pressure to the interior cavity of the sealing element of the invention.

FIG. 3 depicts an example of apparatus which may be utilized in introducing the filler material into the cavity 22 of the sealing element 20. As shown in FIG. 3, the apparatus comprises an air pump 40 which operates to pump air under pressure through a conduit 42 into the upper region 46 of a container 44 having the filler material 34 contained therein. Air pressure in the compartment 46 of the container 44 will force filler material 34 upwardly through a tube 48 and through a conduit 50 into the passage 28 and into the cavity 22. As indicated in FIG. 3, a valve 52 may be provided in the conduit 50 to control flow therethrough. Additionally, a clamp 54 may also be provided in order to seal the interior of the cavity 22 and maintain it under pressure while the adhesive 32 sets. Of course, use of the clamp 54 will enable the valve member 52 to be disengaged from the tube 26 without loss of pressure within the cavity 22.

The container 44 may be provided with a pressure valve and manometer 58 which will register the internal pressure of the container 44 and a safety valve 60 may also be provided. Clamps 62 operate to maintain the container 44 in a sealed condition.

Figure 6:
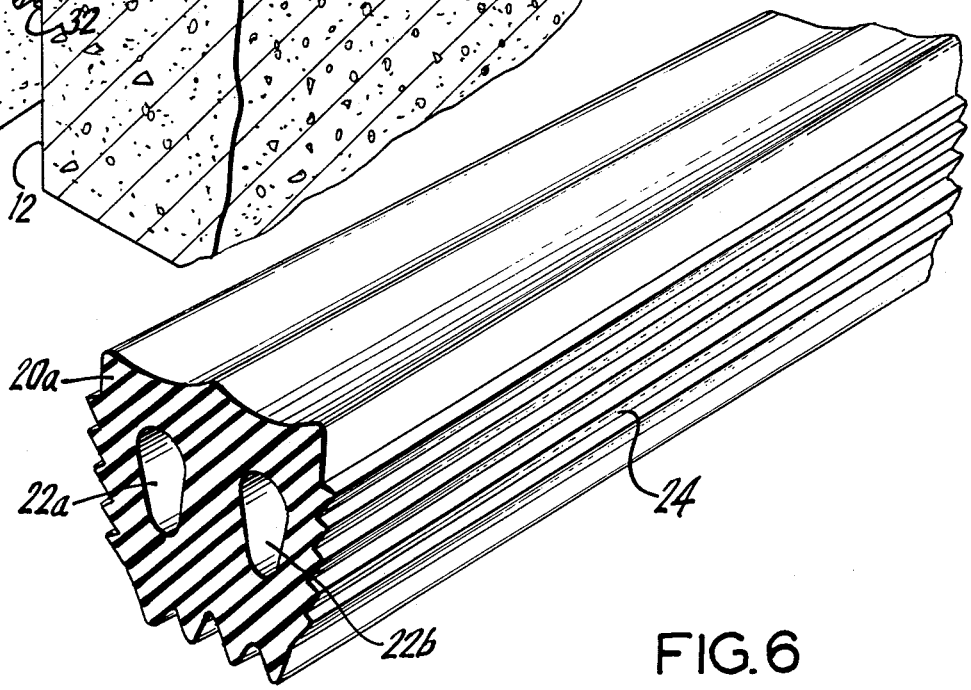
FIG. 6 is a perspective view of a sealing element having two internal cavities.

Although the sealing element 20 has been shown as comprising a single cavity 22, it is to be understood that a plurality of internal cavities may be formed within the sealing element. For example, as shown in FIG. 6, a sealing element 28*a* may be provided with a pair of continuous internal cavities 22*a* and 22*b* each of which may be filled with filler material in the manner previously described in order to form a seal in accordance with the present invention.

It is to be understood that the sealing element 20 of the present invention essentially comprises an expandable, modular joint member which comprises a body formed of resilient material such as, for example, plastic, rubber or similar material. As a result of the construction and selection of material of the body of the sealing element 20, there will be provided the capability of the sealing element 20 to adapt its shape in accordance with the exigencies of its use. The body of the sealing element 20 will function appropriately at any location at which it is applied where a sealing element in accordance with the present invention is to be mounted to form a composite joint assuming a definite shape to produce the sealing function desired.

When the material 34 is introduced into the cavity 22 of the sealing element 20, the pressure of the filler material will promote deformation of the external contour of the sealing element, particularly its contour when viewed in a sectional orientation as shown in FIGS. 1 and 2. As a result, when an appropriate material 34 is introduced into the cavity 22, the resiliency of the material of the sealing element 20 will cause the sealing element to adjust its shape to the respective sides of a joint which is to be sealed. Accordingly, the sealing element 20 will operate to provide a relatively permanent but resilient seal at a joint where it is applied.

In the selection of materials for forming the joint of the present invention, an epoxy resin composition which will set in about 2–4 hours may be utilized as the adhesive. Furthermore, the filler material 34 may be selected to be liquid plastic such as epoxies, polysulphides or the like, which will harden after a specified period of time sufficient to permit the adhesive 32 to set.

In accordance with a further embodiment of the invention, the joint of the present invention may be formed by utilizing air or some other pressurized gas as the filler material introduced into the cavity 22. Such pressurized air or gas would be in place of the liquid plastic material which is previously referred to herein. In such an embodiment, after the adhesive 32 has been applied, the cavity 22 may be filled with the pressurized air in order to cause the sealing element 20 to expand. The inner cavity 22 may be maintained under pressure until the adhesive 32 has been permitted to set. Subsequently, the air pressure within the cavity 22 may be released or, instead, the cavity 22 may be sealed with the air pressure maintained. Thus, the joint which is formed will then be under a somewhat permanent internal air pressure within the cavity 22.

Alternatively, means may be provided for adjusting or varying the pressure within the cavity 32 while the finished joint is in use. For example, in metallic structures, it may be desirable to vary the air pressure within the cavity 22 from time to time while the joint is in use. In such a situation, automatic equipment may be utilized to periodically increase or decrease the internal pressure within the cavity 22 in accordance with sensed conditions.

While specific embodiments of the invention have been shown and described in detail to illustrate the application of the inventive principles, it will understood that the invention may be embodied otherwise without departing from such principles.

What is claimed is:

1. A method for forming a sealed joint between a pair of opposed concrete surfaces forming a gap therebetween comprising the steps of:

locating in said gap between said opposed surfaces an elongated, tubular sealing element consisting of resilient material having first and second side walls juxtaposed respectively against said surfaces, said side walls having a depth less than the thickness of said surfaces and said element having a cavity internally thereof and a plurality of closely-spaced, longitudinal ribs formed in said side walls, said ribs having a distance therebetween less than one-third the depth of said side walls and forming narrow adhesive-receiving grooves therebetween;

applying between said side walls and said opposed surfaces an epoxy resin adhesive material capable of setting after expiration of a set period of time following its application to form a firm adhesive bond between said sealing element and said opposed surfaces;

subjecting said cavity to a gas under pressure after applying said adhesive to cause said sealing element to undergo flexure as a result of the introduction into said cavity of said pressurized gas to compress said adhesive between said side walls and said opposed surfaces during setting of said epoxy resin; and maintaining said gas pressure within said cavity until expiration of said set period of time.

* * * * *